US007946625B2

(12) United States Patent
Yun

(10) Patent No.: US 7,946,625 B2
(45) Date of Patent: May 24, 2011

(54) BINDING STRUCTURE FOR BINDING SHEETS

(76) Inventor: Herbert Yun, Culver City, CA (US)

( * ) Notice: Subject to any disclaimer, the term of this patent is extended or adjusted under 35 U.S.C. 154(b) by 748 days.

(21) Appl. No.: 11/951,586

(22) Filed: Dec. 6, 2007

(65) Prior Publication Data

US 2009/0146406 A1 Jun. 11, 2009

(51) Int. Cl.
*B42D 3/04* (2006.01)

(52) U.S. Cl. ..... 281/19.1

(58) Field of Classification Search ..... 281/20, 281/21.1; 402/20, 21; 206/424, 472, 474, 206/475

See application file for complete search history.

(56) References Cited

U.S. PATENT DOCUMENTS 5,618,061 A 4/1997 Ritterling
6,923,590 B2 * 8/2005 Ward et al. ..... 402/70

* cited by examiner

*Primary Examiner* — Shelley Self
*Assistant Examiner* — Matthew G Katcoff
(74) *Attorney, Agent, or Firm* — Shook, Hardy & Bacon L.L.P.

(57) ABSTRACT

A binding structure for binding sheets to form a book or the like, includes a pair of hard covers, at least one of which has a slide groove, and a middle sheet member connected between the hard covers and extending slidably into the slide groove. The middle sheet member has a spine portion that is exposed between the hard covers when the hard covers are in a closing position and that is concealed at least partially within the slide groove when the hard covers are in an opening position.

6 Claims, 8 Drawing Sheets

BINDING STRUCTURE FOR BINDING SHEETS

BACKGROUND OF THE INVENTION

1. Field of the Invention

This invention relates to a binding structure, more particularly, to a binding structure for binding a stack of sheets to form a book or the like.

2. Description of the Related Art

A traditional hard cover bound book typically has front and back hard covers connected to a hard spine. Because the bound book can create valleys between pages, warping line text or distorting images on the pages, readers have to press down the pages in an attempt to alleviate reading discomfort and to create a flatter reading surface. Furthermore, arched pages in the traditional hard cover book are relatively more likely to be flipped by breezes if no weight is applied to their surface. Besides, when such a hard cover bound book is opened, the traditional hard spine fixed between the front and back covers becomes an obstacle in book cover design so that designers must design around. Some solutions to this problem are to use a slip-cover that is made of a piece of paper separated from the book covers and that has a continuous outer surface area for design, or to provide design elements only on the front and back covers to optically downplay the spine. However, these solutions still have room for improvement.

One such improvement is to use a piece of book cloth covering a soft spine, and front and back covers, with excess cloth portions spanning gaps between the edges of the spine and the front and back covers. The excess cloth portions form hinge connections for the spine and the front and back covers, which allow the soft spine to drop away from the covers when the book is opened. Since the spine is covered by the book cloth and is relatively soft, the book can open flat and lay flat on a surface, thereby eliminating arches of pages and valleys in between pages. However, the spine is still showing and becomes a protrusion from the otherwise flat surface of the covers. This makes the spine harder to design around when designing book covers.

An other improvement that enables a book to be opened flat utilizes a coil as a binding structure. Holes are punched in one side of covers and pages, and a plastic or metal coil is wound through the holes, binding the covers and pages together. Such a binding structure is aesthetically and structurally inferior to traditional spines in that the coil protrudes in between the pages when the book is opened flat, and that there is a high risk of covers or pages tearing out because the punctured holes are within close proximity to one another.

SUMMARY OF THE INVENTION

An object of the invention is to provide a novel binding structure for a book or the like, which has a slidable spine that is concealable within hard covers when the book is opened, thereby permitting the book to be opened completely flat.

An other object of the invention is to provide a novel binding structure for a book or the like, which has a spine that can be slid into front and back hard covers when the book is opened, thereby permitting the outer surfaces of front and back covers to form a large surface area which is uninterrupted by the spine and with which design elements can flow continuously from the front cover to the back cover and vice versa.

Still an other object of the invention is to provide a binding structure for a book or the like, which provides the book with a relatively flat reading surface for added reading comfort and reduced text and image distortion.

Accordingly, the present invention provides a binding structure for binding a stack of sheets to form a book, which comprises a pair of hard covers having inner surfaces adapted to be attached respectively to two of the sheets, and a middle sheet member connected between the hard covers. The hard covers are movable relative to each other between an opening position to open the book and a closing position to close the book. At least one of the hard covers has a slide groove.

The middle sheet member extends slidably into the slide groove, and has a spine portion that is exposed between the hard covers when the hard covers are in the closing position and that is concealed at least partially within the slide groove when the hard covers are in the opening position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
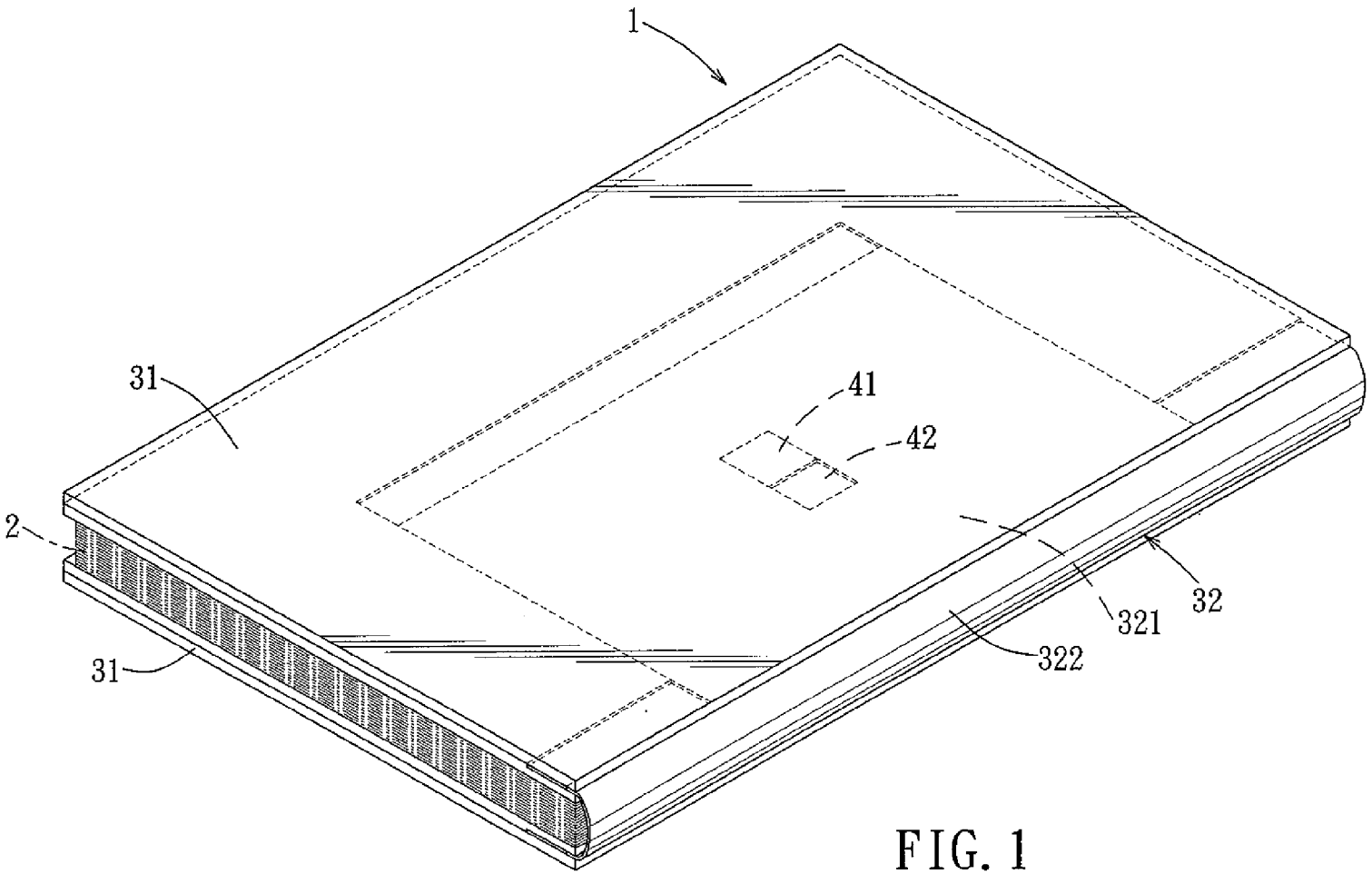
FIG. 1 is a perspective view of a hard cover bound book incorporating a binding structure according to the first preferred embodiment of the present invention.
Figure 2:
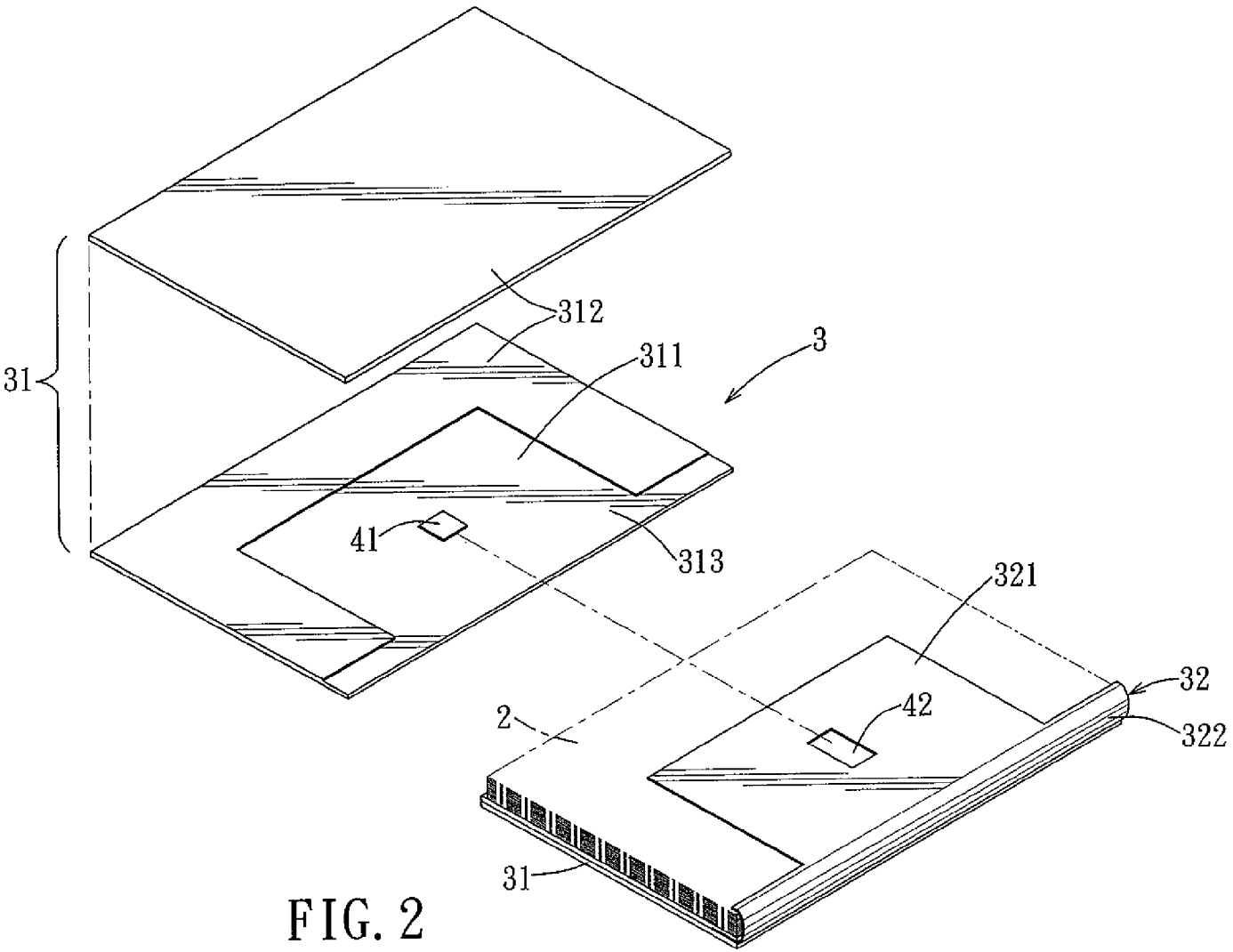
FIG. 2 is a partly exploded view of the hard cover bound book.

Before the present invention is described in greater detail, it should be noted that same reference numerals have been used to denote like elements throughout the specification.

Referring to FIGS. 1-6, there is shown a hard cover bound book 1 that incorporates a binding structure 3 according to the first preferred embodiment of the present invention. In particular, the hard cover bound book 1 includes a stack of sheets 2, and the binding structure 3 to bind the sheets 2 so as to form the hard cover bound book 1. The binding structure 3 includes two hard covers 31 and a middle sheet member 32 connected between the hard covers 31. The hard covers 31 have inner surfaces 310 respectively fixed to the first one and the last one of the sheets 2. The hard covers 31 are movable relative to each other between an opening position to open the book 1 and a closing position to close the book 1.

Each hard cover 31 is provided with a slide groove 311. Any suitable method may be used to form the slide groove 311 in each hard cover 31. In this preferred embodiment, each hard cover 31 is made up of two plate layers 312. One of the plate layers 312 is formed with the slide groove 311 and is placed in abutment with the other plate layer 312, thereby covering the slide groove 311 and leaving an opening 313 for an access to the slide groove 311.

Referring back to FIGS. 2 and 6, the middle sheet member 32 has two opposite lateral slide portions 321 extending slidably and respectively into the slide grooves 311 of the hard covers 31 through the respective openings 313, and a spine portion 322 disposed between the lateral slide portions 321.

Figure 3:
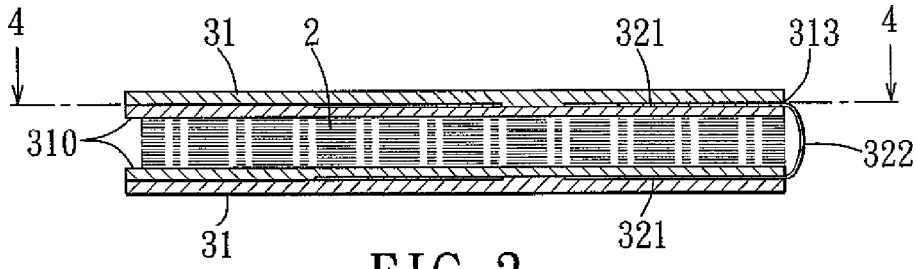
FIG. 3 is a sectional view showing the hard cover bound book in a closed position.
Figure 4:
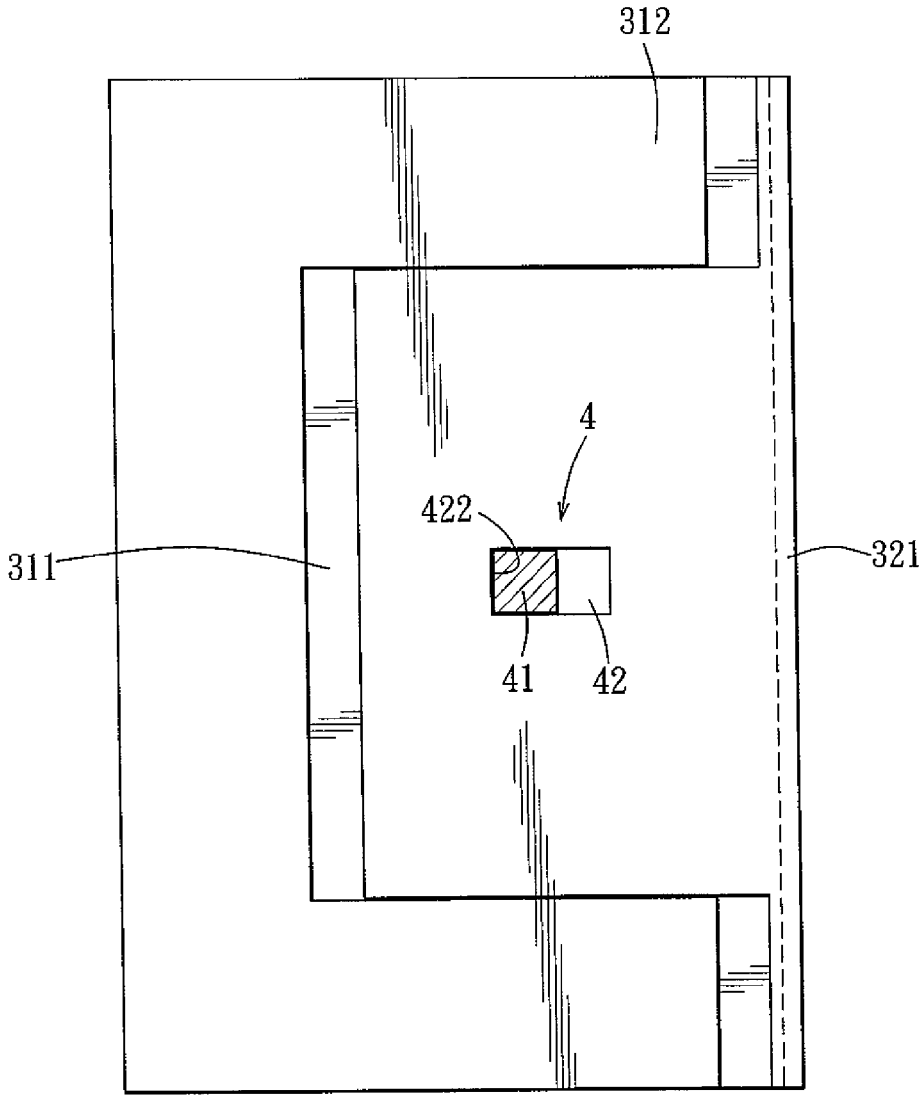
FIG. 4 is a sectional view taken along line 4-4 of FIG. 3.
Figure 5:
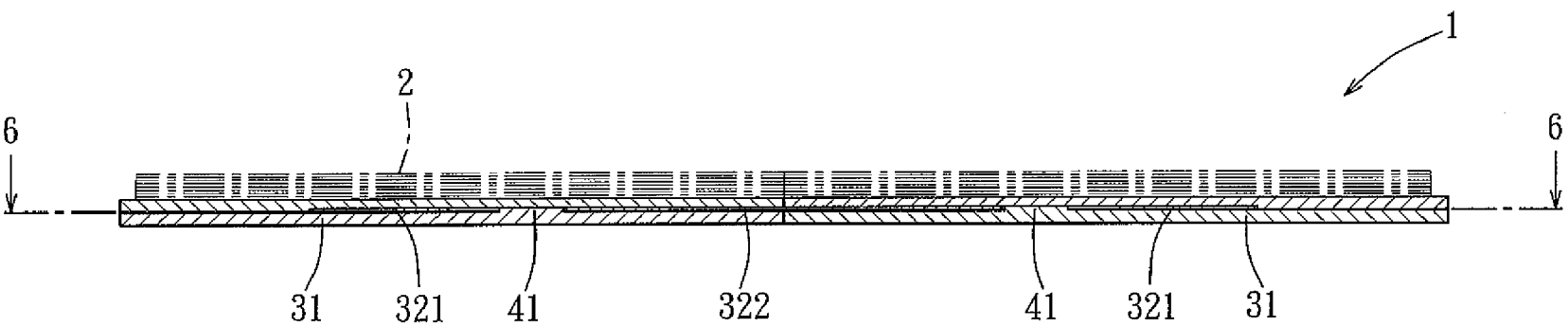
FIG. 5 is an other sectional view showing the hard cover bound book in a fully opened position.
Figure 6:
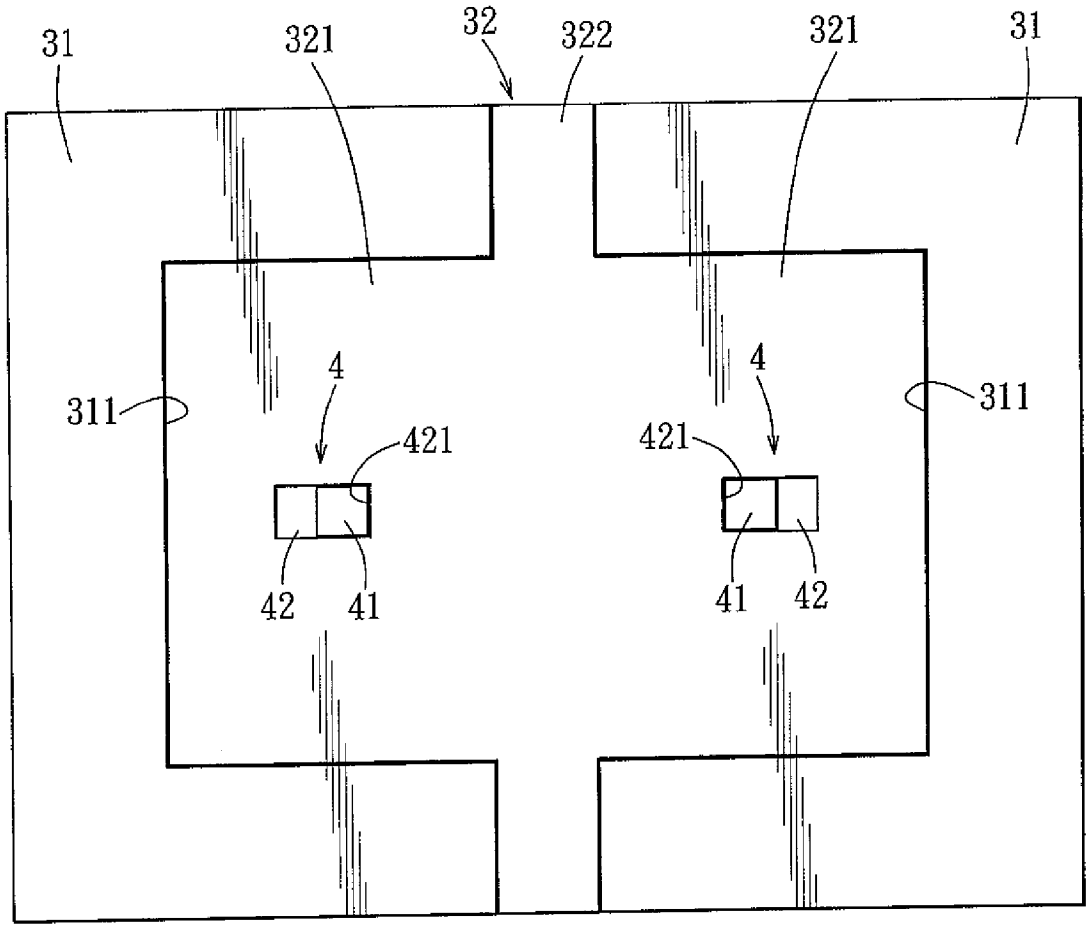
FIG. 6 is a sectional plan view taken along line 6-6 of FIG. 57

The spine portion 322 is exposed between the hard covers 31 when the hard covers 31 are in the closing position, as shown in FIGS. 3 and 4, and is concealed in the slide grooves 311 in the hard covers 31 when the hard covers 31 are in the opening position, as shown in FIGS. 5 and 6. The length of the spine portion 322 is slightly smaller than that of the hard covers 31 so that the spine portion 322 is allowed to slide into the slide grooves 311.

Particularly, when the hard covers 31 are completely opened flat, the spine portion 322 slides into the slide grooves 311 in the hard covers 31 so that the hard covers 31 completely conceal the spine portion 322. When the hard covers 31 are moved to the opening position from the closing position, the spine portion 322 slides outwardly from the slide grooves 311 so that the spine portion 322 is exposed gradually. The binding structure 3 further includes two slide control mechanisms 4 that control the sliding movements of the lateral slide portions 321. In this preferred embodiment, each slide control mechanism 4 includes a protrusion 41 formed on the respective hard cover 31 within the respective slide groove 311, and an elongated slot 42 formed in the respective lateral slide portion 321. The slot 42 is elongated in the sliding direction of the spine portion 322. The protrusion 41 extends slidably into the slot 42. The slot 42 has a first slot edge 421 that engages the protrusion 41, as shown in FIG. 6, when the lateral slide portion 321 moves inward, and a second slot edge 422 that engages the protrusion 41, as shown in FIG. 4, when the lateral slide portion 321 moves outward.

Because the slots 42 and the protrusions 41 interengage at the same time, the inward or outward sliding motions of the spine portion 322 in the two hard covers 31 can begin or stop at the same time. In particular, when the hard cover bound book 1 is fully opened (FIG. 6), the slots 42 engage the respective protrusions 41 at the same time on both sides of the spine portion 322, stopping the sliding motion of the spine portion 322 on both sides. When the hard cover bound book 1 is closed from its fully opened position, since the slots 42 are in engagement with the respective protrusions 41 on both sides, as shown in FIG. 6, the spine portion 322 can begin moving outwardly of the hard covers 31 at the same time.

Figure 7:
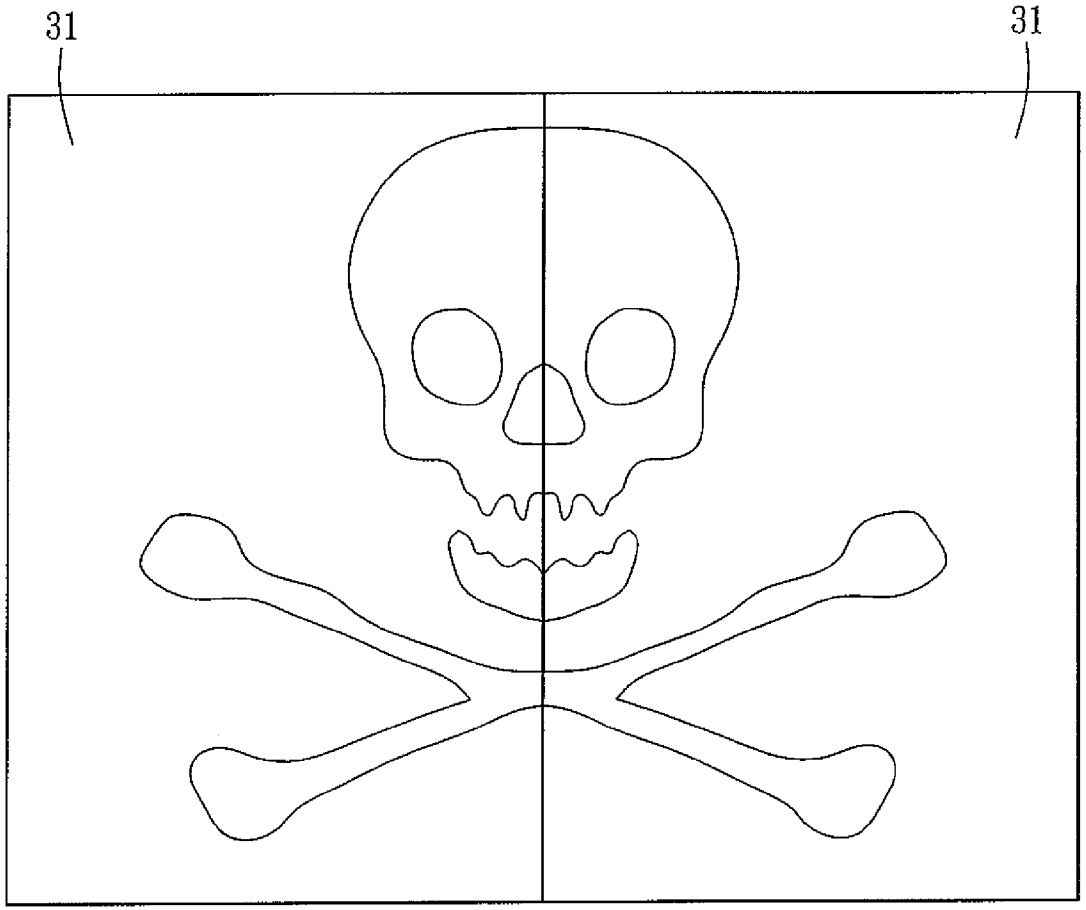
FIG. 7 is a plan view showing outer surfaces of hard covers of the hard cover bound book.

The slide control mechanisms 4 determine how much the spine portion 322 is concealed or exposed. By suitably designing the slide control mechanisms 4, the spine portion 322 can be concealed completely or partially within the hard covers 31 when the hard covers 31 are fully opened. Referring to FIG. 7, there is shown a design or figure on the outer surfaces of the hard covers 31 which are fully opened flat. Since the spine portion 322 is completely concealed in the hard covers 31, the hard covers 31 provide a continuously flat large outer surface that is not interrupted by the spine portion 322. Thus, there is no obstacle to interfere with the extension of the design or figure from one of the hard covers 31 to the other hard cover 31. Therefore, a variety of design elements may be provided readily on the hard covers 31, and there is no need to design around the spine portion.

While the binding structure 3 of this embodiment has two hard covers 31 provided with the respective slide grooves 311, and the middle sheet member 32 is provided with two lateral slide portions 321, the present invention should not be limited thereto. The binding structure 3 may be alternatively arranged such that the middle sheet member 32 has only one lateral slide portion 321 connected to the spine portion 322, and the slide groove 311 is provided only in one of the hard covers 31. In this case, the middle sheet member 32 should be fixed to the other hard cover 31 which has no slide groove 311, and the spine portion 322 will slide relative to the hard cover 31 that has the slide groove 311.

Figure 8:
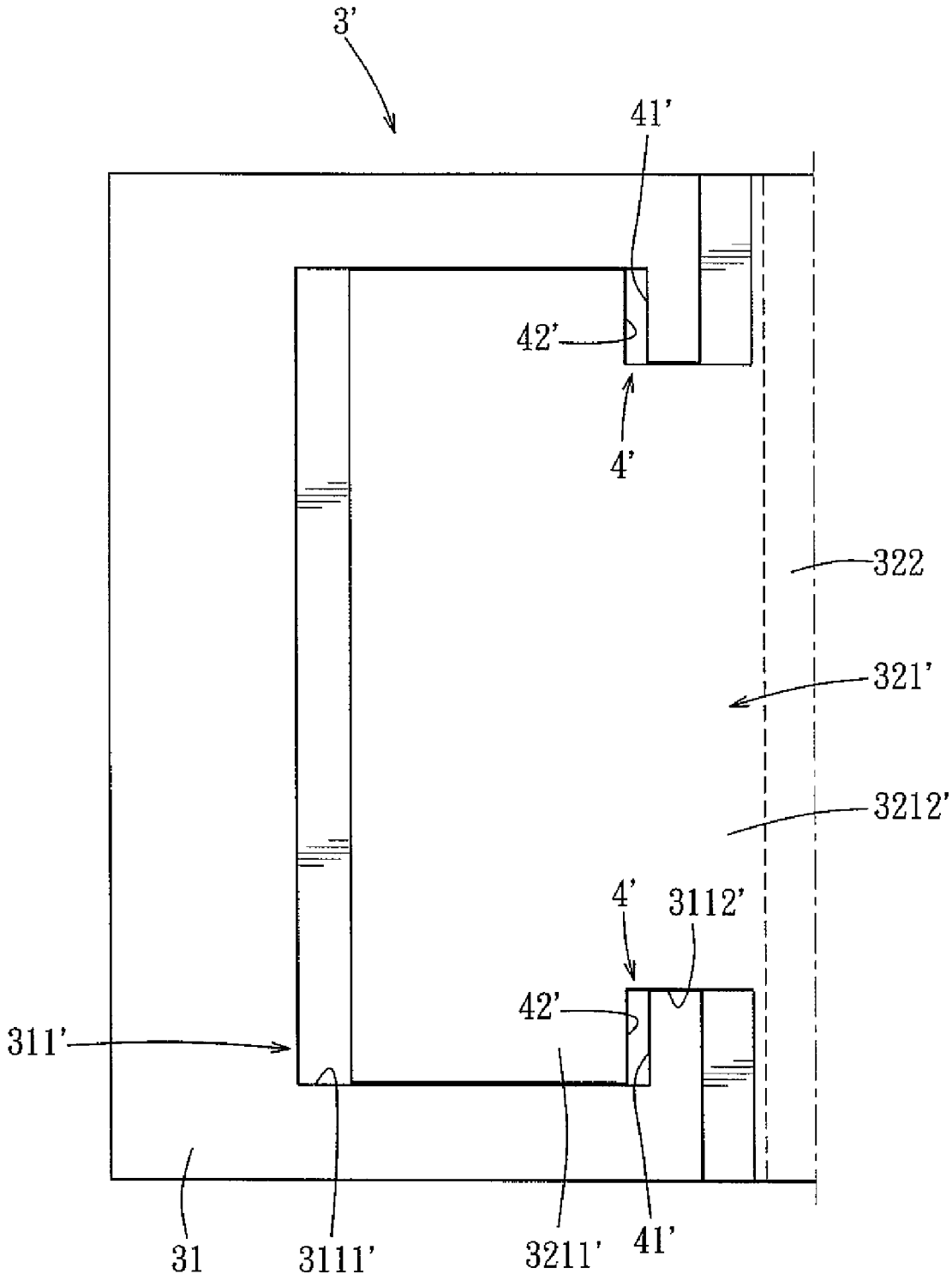
FIG. 8 is a fragmentary plan view of the binding structure according to the second preferred embodiment of the present invention.

Referring to FIG. 8, there is shown a binding structure 3' according to the second preferred embodiment of the present invention, which differs from the binding structure 3 of the previous embodiment in the configurations of the slide grooves 311', the lateral slide portions 321' and the slide control mechanisms 4'.

Each lateral slide portion 321' has a widened part 3211' and a necked part 3212'. The necked part 3212' extends from one side of the spine portion 322, and the widened part 3211' is connected to the necked part 3212' opposite to the spine portion 322. Each slide groove 311' has a broad groove portion 3111' receiving the widened part 3211', and a narrow groove portion 3112' receiving the necked part 3212'. Each slide control mechanism 4' has two opposite first shoulder edges 41' disposed on an edge of the respective hard cover 31 that confines the slide groove 311', and two opposite second shoulder edges 42' disposed on the respective lateral slide portion 321'. In particular, the first shoulder edges 41' are formed at a connection of the broad groove portion 3111' and the narrow groove portion 3112'. The second shoulder edges 42' are formed at a connection of the widened part 3211' and the necked part 3212'.

In this embodiment, the inward or outward sliding motions of the spine portion 322 in the two hard covers 31 take place one before the other. When the hard covers 31 are closed, the second shoulder edges 42' engage the respective first shoulder edges 41' so that the outward sliding of the spine portion 322 is stopped. When the hard cover bound book 1 is opened, one side of the spine portion 322 will first slide inwardly of the broad groove portion 3111' of the respective hard cover 31, partially concealing a portion of the spine portion 322 before the other side of the spine portion 322 slides inwardly of the other hard cover 31. Once the sliding of said one side of the spine portion 322 stops, the other side of the spine portion 322 will slide inwardly of the other hard cover 31, concealing the remainder of the spine portion 322. The slide control mechanism 4' does not need to have the first and second shoulder edges 41' and 42' interengaged at one side of the spine portion 322 for the other side of the spine portion 322 to begin sliding into the respective hard cover 31.

Figure 9:
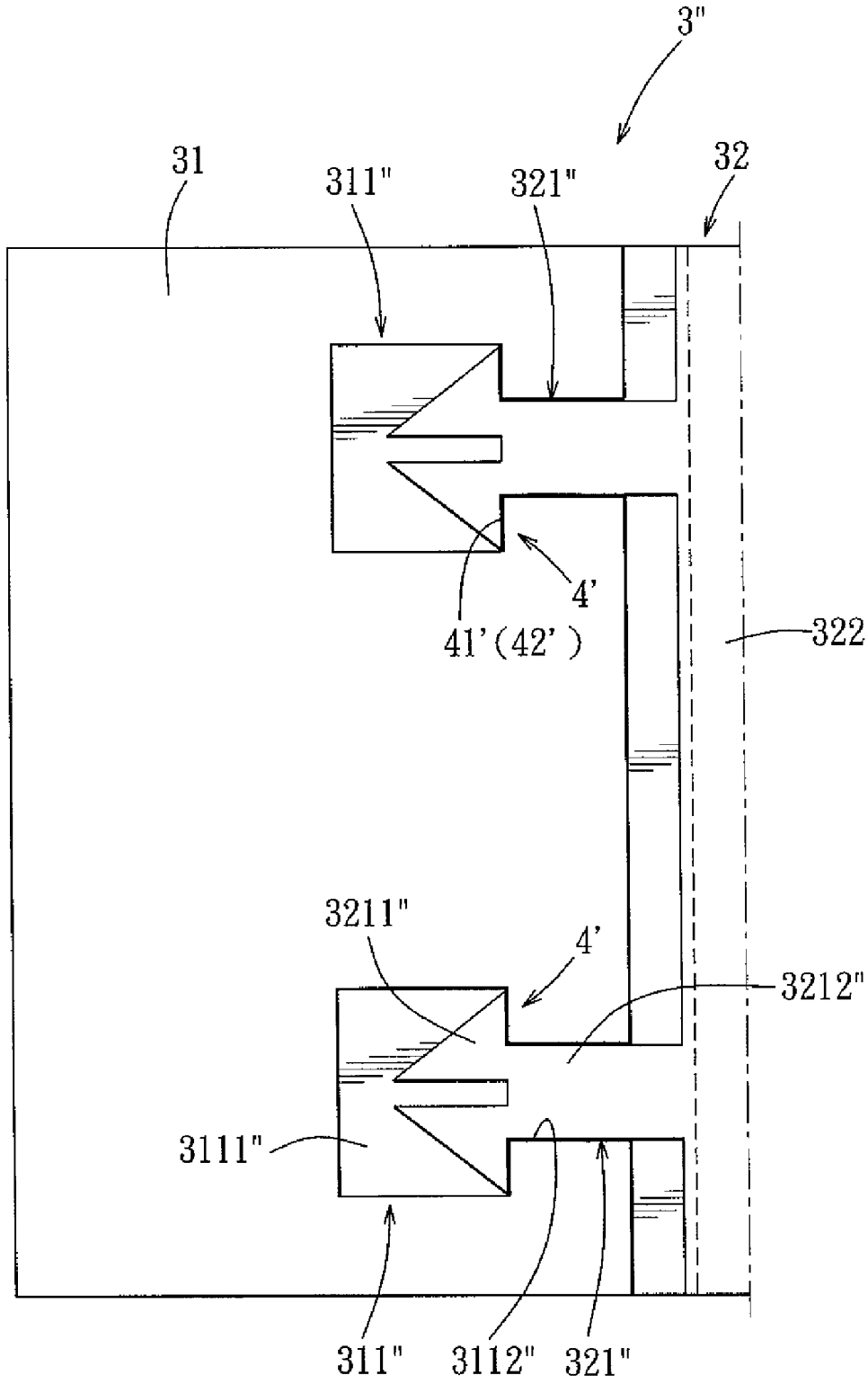
FIG. 9 is a fragmentary plan view of the binding structure according to the third preferred embodiment of the present invention.

Referring to FIG. 9, there is shown a binding structure 3" according to the third preferred embodiment of the present invention. The binding structure 31" differs from the binding structure 3' in having two slide grooves 311" and two slide control mechanisms 4' in each hard cover 31, and two lateral slide portions 321" on each side of the spine portion 322. Each slide groove 311" is substantially similar in shape to the slide groove 311' of the binding structure 3', and has the broad groove portion 3111", and the narrow groove portion 3112". Each lateral slide portion 321" has a necked part 3212" and a widened part 3211" that is bifurcated and that has a pointed end. Each slide control mechanism 4' has the first and second shoulder edges 41' and 42'.

Although the binding structure 3, 3' or 3" is described as being used in the hard cover bound book, application of the present invention is not limited to books. The binding structure of the invention may also be applied to photo albums, sketch books, and other similar reading or displaying articles.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A binding structure for binding a stack of sheets to form a book, comprising:

a pair of hard covers each having an inner surfaces adapted to be attached to one of the sheets, an outer surface opposite to said inner surface, and an edge interconnecting said inner and outer surfaces, said hard covers being movable relative to each other between an opening position to open the book and a closing position to close the book, at least one of said hard covers having a slide groove formed between said inner and outer surfaces, and an opening communicated with said slide groove and formed in said edge; and a middle sheet member connected between said hard covers and having a lateral slide portion extending slidably into said slide groove through said opening, said middle sheet member further having a spine portion that is connected to said lateral slide portion and that is exposed between said hard covers when said hard covers are in said closing position, said spine portion sliding into said slide groove through said opening when said hard covers are in said opening position and out of said slide groove when said hard covers are in said closing position, wherein said opening is large enough to permit said spine portion to slide into said slide groove.

2. The binding structure of claim 1, wherein said middle sheet further has an elongated slot formed in said lateral slide portion, and said one of said hard covers further has a protrusion formed within said slide groove and slidably extending into said elongated slot.

3. The binding structure of claim 1, wherein said middle sheet further has a first shoulder edge formed on said lateral slide portion, and said one of said hard covers further has a second shoulder edge formed on an edge of said one of said hard covers that bounds said slide groove, said first shoulder edge being engageable with said second shoulder edge.

4. The binding structure of claim 3, wherein:

said lateral slide portion has a necked part extending from one side of said spine portion, and a widened part connected to said necked part opposite to said spine portion, said first shoulder edge being formed at a connection of said necked part and said widened part; and said slide groove has a broad groove portion receiving slidably said widened part, and a narrow groove portion receiving slidably said necked part, said second shoulder edge being formed at a connection of said broad groove portion and said narrow groove portion.

5. The binding structure of claim 4, wherein said widened part of said lateral slide portion is bifurcated and has a pointed end.

6. A binding structure for binding a stack of sheets to form a book, comprising:

a pair of hard covers each having an inner surface adapted to be attached to one of the sheets, an outer surface opposite to said inner surface, and an edge interconnecting said inner and outer surfaces, said hard covers being movable relative to each other between an opening position to open the book and a closing position to close the book, each of said hard covers having a slide groove formed between said inner and outer surfaces, and an opening formed in said edge and communicated with said slide groove; and a middle sheet member having two opposite lateral slide portions extending respectively into said slide grooves of said hard covers through said openings of said slide grooves, and a spine portion between said lateral slide portions, said spine portion being exposed between said edges of said hard covers when said hard covers are in said closing position, said spine portion sliding into both of said slide grooves through said openings when said hard covers are in said opening position and out of said slide grooves when said hard covers are in said closing position.

* * * * *